United States Patent [19]

Frampton

[11] 3,984,796

[45] Oct. 5, 1976

[54] MAGNETIC HOISTS

[76] Inventor: George W. Frampton, 4622 Sherwood Drive, Pittsburgh, Pa. 15236

[22] Filed: Aug. 22, 1975

[21] Appl. No.: 606,888

[52] U.S. Cl. ..... 335/291; 335/294

[51] Int. Cl.[2] ..... H01F 7/20

[58] Field of Search ..... 335/289, 290, 291, 292, 335/294

[56] References Cited

UNITED STATES PATENTS

| | | | |
|---|---|---|---|
| 2,761,094 | 8/1956 | Frampton | 335/291 |
| 3,521,209 | 7/1970 | Fritz | 335/291 |
| 3,693,126 | 9/1972 | Rybak | 335/291 |
| 3,763,453 | 10/1973 | Schurr | 335/292 |

*Primary Examiner*—George Harris
*Attorney, Agent, or Firm*—William J. Ruano

[57] ABSTRACT

An electro-magnet or chuck for lifting scrap metallic particles, comprising a housing essentially of magnetic material. Enclosed are a plurality of spirally wound, superposed coils. Each coil has a central portion which is wound as a bimetal, that is, one winding having magnetic properties, such as an iron winding, and the other, non-magnetic, such as an aluminum winding in series with an outer winding portion of non-magnetic turns. The housing has an annular bottom portion of durable non-magnetic material, such as stainless steel, which is magnetically bridged by scrap magnetic particles being lifted.

3 Claims, 2 Drawing Figures

MAGNETIC HOISTS

This invention relates to improvements in the electro-magnetic lifting chuck or magnetic hoist covered in my U.S. Pat. No. 2,761,094, dated Aug. 28, 1956.

A disadvantage in my prior patented magnetic hoist is that it involves an excessive amount of weight as a consequence of the spiralling of magnetic material, namely, iron ribbon throughout the entire diameter.

Another disadvantage in my prior hoist or chuck is that the lower plate is made up of welded spirally wound ribbons of bimetallic material wherein adjoining bimetal windings are welded together, therefore there is a strong tendency for leakage to develop between said ribbons which may cause disintegration of the insulation of the coil assembly inside the housing.

Still another disadvantage is that only a single spirally wound coil is used which is not readily accessible, also the coils do not provide maximum ampere turns for a given coil space, therefore do not provide maximum efficiency.

An object of my invention is to provide a novel magnetic hoist which is devoid of the abovenamed disadvantages.

A more specific object of my invention is to provide a novel magnetic hoist with a combination of bimetallic coils and non-magnetic coils such as to give maximum ampere turns or maximum electro-magnetic lifting power with minimum weight of the lifting chuck.

Another object of the present invention is to provide a magnetic hoist with a bottom plate which contains a perfect seal with minimum weight.

Another object of the present invention is to provide a magnetic chuck with a plurality of separate spirally wound coils, each of bimetallic windings in series with non-magnetic windings, insulated from each other, any of which coils may be easily accessible and replaced.

Figure 1:
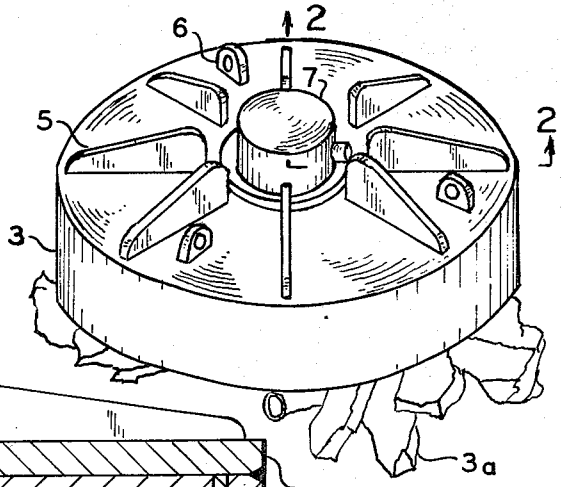
Figure 2:
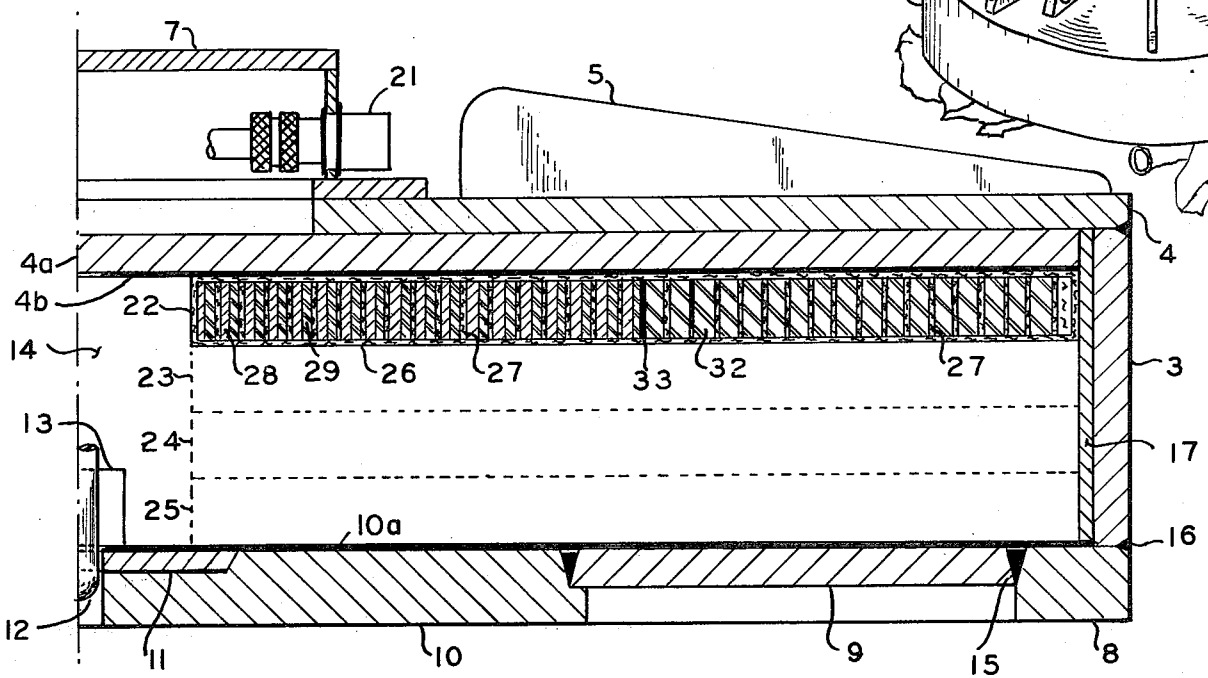

Other objects and advantages will become more apparent from a study of the following description taken with the accompanying drawing wherein:

FIG. 1 is a top perspective view of a magnetic hoist or lifting chuck embodying the principles of the present invention; and, FIG. 2 is an enlarged, cross sectional view taken along line 2—2 of FIG. 1 showing one half of the cross section of the hoist, inasmuch as the other half is identical and complementary.

Referring more particularly to FIG. 1 of the drawing, numeral 3 denotes a hollow cylindrical outer casing of magnetic material, such as iron, having an annular magnetic cover 4, preferably of iron, welded thereto, onto which cover are welded a plurality of radially extending fins 5. While eight of such fins are shown, any larger or smaller number may be used instead. On cover 4 there are, integrally secured, a plurality of hoist lifting eyes 6 for engaging hoist rings and the like, so that the entire chuck may be lifted by powered lifting equipment such as a crane, or the like. A central cover plate 7 of metal such as iron is secured to the cover 4 so as to complete the magnetic hoist cover, and through the sides of which an electrical terminal 21 is insulatingly extended for connection to inner terminals in the space 14 of the various coils 23, 23, 24 and 25.

The bottom plate 8 of iron is annular shaped and welded at 16 to the outer casing 3 and welded at 15 to a ring 9 of durable non-magnetic material, such as stainless steel which is preferred over the less durable aluminum, brass or other non-ferrous metal. Ring 9, in turn, is welded to a central ring 10 of iron, or other magnetic material, for completing the bottom plate of the chuck. Ring 10 has a central well formed in its top portion for receiving a correspondingly shaped magnetic ring 11 or iron, steel or other magnetic metal, through which a pin 12 is extended, secured to a pin holder 13 which is supported on a centrally perforated, non-magnetic disc 10*a*.

Below cover 4 is a disc 4a of magnetic material, such as iron, to form a cover plate for the coil assembly comprising coils 22, 23, 24 and 25 of identical construction and which are separately covered at the top and bottom by insulating material, such as 26, and which have insulating material, such as 27, between each turn or winding.

An interior lining 17 of magnetic material, such as iron, is provided within and adjacent casing 3. Interior linings 4*b* and 10*a* may also be of stainless steel or other non-magnetic material.

An important feature of the present invention relates to the winding construction of each of the separate, identical coils 22, 23, 24 and 25. Such construction is shown only for coil 22, but it should be understood that the same construction is used in each of the other coils 23, 24 and 25.

Coil 22 is in the form of a spirally wound bimetal comprising a strip of magnetic material 29, such as iron, contiguous to a strip of non-magnetic material 29, preferably aluminum because of its lightness which bimetal is wrapped spirally, with insulation between each winding, such as shown in my prior patent. However, the bimetallic winding extends only between the innermost winding and the joint or terminal 33, from which point, outwardly, there is wound only non-magnetic coils 32 preferably of aluminum, each separated by insulation 27 between the turns or coils, as well as insulation 26 at the top and bottom ends of the coil assembly, thus forming a pancake coil 22. The non-magnetic coils 32 may be of the same cross-section as those in the bimetallic winding, however, it is preferable to make them larger in cross-section, that is, equal to that of the bimetallic winding, or so as to have the same resistance as the combined cross-sections of the iron and aluminum bimetallic windings to provide the same current carrying capacity.

Fused or welded joint 33 connects, in series, the outermost non-magnetic coil to the inner-most non-magnetic coil 27 to provide a series connection of all non-magnetic turns throughout the entire diameter of the coil assembly 22. The advantage of eliminating the magnetic coils between connection 33 and points radially outwardly is that it will eliminate the heavy weight of such magnetic coils without sacrificing lifting power or the magnetic turns of the chuck in any material way since a greater number of non-magnetic turns will replace the bimetallic turns of my prior patented structure. Coils 22, 23, 24 and 25 are connected in series by connecting the outermost turn of aluminum to the outermost aluminum turn of coil 23, but changing the direction of spiralling so that the magnetic lines of force reinforce each other. Similarly the inner most turn of coil 23 is connected to that of coil 24 which, changing the direction of the spiral of coil 24, causes the flux lines of the coils to go in the same direction to make them cumulative. The outermost turn of coil 24 is connected to that of coil 25 while the direction of the spiral of the latter is reversed. Finally, the innermost turn of coil 25 is connected to the power terminal in space 14 (not shown). An effective and inexpensive way of making terminal connections, such as at 33 is to overlap and punch press the respective terminals into a laterally offset depression. Such punch pressing may be done at intervals throughout the bimetallic coils to hold the iron and aluminum strips of each turn tightly together.

It should be noted that the respective bimetallic turns, as well as the respective non-metallic turns 32 of each of the coil assemblies 22, 23, 24 and 25, are in vertical registry.

In operation, when the crane lifts the magnetic chuck by hooks or rings extending through eyes 6, it will attract metallic parts, such as 3*a* (FIG. 1) by virtue of the completion of a magnetic path throughout the entire housing of the chuck comprising the cover parts 4 and 4*a*, sidewall 3 and bottom wall parts 8, 9 and 10, particularly when steel and iron scrap parts 3*a*, to be lifted, bridge the space between bottom magnetic parts 8 and 10, so as to complete a magnetic path therebetween.

In effect, when the coils are energized, there is a central magnetic pole in the locality of space 14 and an opposite pole through outer casing 3. Also there are minute individual poles formed by each bimetallic turns in the respective coil assemblies 22, 23, 24 and 25. Non-magnetic connecting plate 9 cuts down on the lag or hysterisis otherwise involved if it were of iron or other magnetic material.

Thus it will be seen that I have provided a magnetic hoist or electro-magnetic lifting chuck having considerably less weight for a given volume, as compared to that described in my prior patent, and which has a casing with a bottom plate which is far more leak-proof, also which has coils that provide greater ampere-turns per coil space so as to greatly increase the electro-magnetic efficiency of the magnetic hoist, making it capable of carrying far greater loads for a given weight of magnetic hoist, than heretofore possible.

While I have described a single specific embodiment of my invention it will be understood that this is by way of illustration only and that various changes and modifications may be contemplated in my invention and within the scope of the following claims.

I claim:

1. A lifting electro-magnet comprising a cylindrical housing substantially of magnetic material, a plurality of spirally wound, superposed coils concentric with said cylindrical housing and encased in insulation, each of said coils having a central portion in which the windings are bimetallic with one winding having magnetic properties and the other having non-magnetic properties, each of said coils having an outer portion solely of non-magnetic windings insulated from each other and connected in series with the outermost non-magnetic winding of said central portion, the bottom of said housing having an outer annular portion of non-magnetic material located essentially underneath said non-magnetic windings and which is bridged by scrap magnetic lifted by said electomagnet.

2. A lifting electromagnet as recited in claim 1 wherein said non-magnetic windings are of aluminum.

3. A lifting electromagnet as recited in claim 1 wherein a central cylindrical well is provided in said housing in which terminals for said coils are located.

* * * * *